US010428756B2

(12) United States Patent
Velusamy et al.

(10) Patent No.: US 10,428,756 B2
(45) Date of Patent: Oct. 1, 2019

(54) POWER-ECONOMY MODE CONTROL SYSTEM FOR A VEHICLE

(71) Applicant: Mahindra and Mahindra Limited, Nashik (IN)

(72) Inventors: Ramasamy Velusamy, Nashik (IN); Rehan Shaik, Nashik (IN)

(73) Assignee: MAHINDRA AND MAHINDRA LIMITED, Nashik (IN)

( * ) Notice: Subject to any disclaimer, the term of this patent is extended or adjusted under 35 U.S.C. 154(b) by 282 days.

(21) Appl. No.: 14/404,481

(22) PCT Filed: Jun. 3, 2013

(86) PCT No.: PCT/IN2013/000349
§ 371 (c)(1),
(2) Date: Nov. 28, 2014

(87) PCT Pub. No.: WO2013/183063
PCT Pub. Date: Dec. 12, 2013

(65) Prior Publication Data

US 2015/0112577 A1 Apr. 23, 2015

(30) Foreign Application Priority Data

Jun. 1, 2012 (IN) ..... 1626/MUM/2012

(51) Int. Cl.
*F02D 41/30* (2006.01)
*F02D 41/24* (2006.01)
(Continued)

(52) U.S. Cl.
CPC ..... *F02D 41/3064* (2013.01); *F02D 11/105* (2013.01); *F02D 41/2422* (2013.01);
(Continued)

(58) Field of Classification Search
CPC ..... F02D 41/3064; F02D 11/105; F02D 41/2422; F02D 2250/18; F02D 2200/604; G07C 5/0808
(Continued)

(56) References Cited

U.S. PATENT DOCUMENTS 4,700,819 A * 10/1987 Nishikawa ..... F16H 61/143 192/3.31
4,898,138 A * 2/1990 Nishimura ..... F02D 11/105 123/399
(Continued)

FOREIGN PATENT DOCUMENTS

DE 102009008872 A1 8/2010
EP 0110226 A2 6/1984
(Continued)

*Primary Examiner* — Joseph J Dallo
(74) *Attorney, Agent, or Firm* — Mannava & Kang, P.C.; Vinay Malik

(57) ABSTRACT

The present invention is related to a vehicle provided with operation selection mode. In particular, the present invention is related to a common rail electronically controlled vehicle provided with operation selection mode wherein the user can select either of the power mode and the economy mode of vehicle operation depending on the road conditions. The system of the present invention provides a system to enable selection of power mode operation for power conscious driving requirement or economy mode operation for fuel conscious driving option obviating the use of additional interface devices between engine and engine control unit.

7 Claims, 9 Drawing Sheets

(51) Int. Cl.
*F02D 11/10* (2006.01)
*G07C 5/08* (2006.01)

(52) U.S. Cl.
CPC ..... *G07C 5/0808* (2013.01); *F02D 2200/604* (2013.01); *F02D 2250/18* (2013.01)

(58) Field of Classification Search
USPC ..... 701/54, 102–105, 110–112
See application file for complete search history.

(56) References Cited

U.S. PATENT DOCUMENTS 4,976,239 A * 12/1990 Hosaka ..... F02D 11/105 123/399
5,445,128 A * 8/1995 Letang ..... B60K 31/045 123/436
6,687,602 B2 * 2/2004 Ament ..... F02D 11/105 123/198 F
7,454,282 B2 * 11/2008 Mizuguchi ..... F02D 29/02 477/97
7,487,033 B2 * 2/2009 Hijikata ..... F02D 11/105 123/406.47
7,490,000 B2 2/2009 Siddiqui et al.
7,621,127 B2 * 11/2009 Robinson ..... F02D 41/0007 180/197
8,224,560 B2 7/2012 Motonaga et al.
8,352,150 B2 * 1/2013 Hijikata ..... F02D 11/105 701/102
8,655,576 B2 * 2/2014 Niwa ..... B60W 10/11 701/123
2002/0165658 A1 * 11/2002 Ament ..... F02D 11/105 701/110
2007/0155583 A1 * 7/2007 Tabata ..... B60W 10/10 477/37
2007/0271026 A1 * 11/2007 Hijikata ..... F02D 11/105 701/103
2008/0092849 A1 * 4/2008 Mizuguchi ..... F02D 29/02 123/339.16
2008/0250786 A1 * 10/2008 Robinson ..... F02D 41/0007 60/602
2008/0300768 A1 * 12/2008 Hijikata ..... F02D 11/105 701/102
2010/0094525 A1 * 4/2010 Redon ..... F02D 41/0205 701/103
2012/0059561 A1 * 3/2012 Niwa ..... B60W 10/06 701/54

FOREIGN PATENT DOCUMENTS

JP 58013140 A * 1/1983
JP H05332236 A 12/1993
JP 2005214086 A 8/2005
JP 2011196346 A 10/2011

* cited by examiner

POWER-ECONOMY MODE CONTROL SYSTEM FOR A VEHICLE

The present application is a national phase application filed for PCT/IN2013000349 dated 3 Jun. 2013, which claims priority from Indian Application Number 1626/MUM/2012, filed on 1 Jun. 2012, the disclosure of which is hereby incorporated by reference herein.

TECHNICAL FIELD

The present invention is related to a vehicle provided with operation selection mode. In particular, the present invention is related to a common rail electronically controlled vehicle provided with operation selection mode wherein the user can select either of the power mode and the economy mode of vehicle operation depending on the road and load conditions.

BACKGROUND

In the competitive and crowded vehicle market, cost of ownership of the vehicle has become one of the defining selection factors at the consumer end. The effective cost of the vehicle is predominantly dependent on the initial and the operation/running cost of the vehicle. The operational cost is mainly dependents on the fuel consumption per unit distance, as it relates directly to the engine performance.

However the engine torque, speed and power output define the driving mode of the vehicle. The vehicle needs to be operated in a dynamic mode in which the parameters have to be optimized for minimal fuel consumption. Typical driving tracks such as in Ghats i.e. on uphill roads with series of bends, and conditions such as overtaking, high power is preferable but the engine operated in a minimal fuel consumption mode.

The challenge and the unmet need have been to provide an engine system that meets the varying requirements, offer choice to the end user of selecting and operating in power or economic mode, in a relatively system simple obviating the need for complex constructions, interfaces and yet achieving the desired fuel economy and enhanced performance.

Prior Art discloses several systems but have failed to comprehensively meet the above requirements.

U.S. Pat. No. 7,490,000 discloses a fuel economy control module with associated logic that allows the vehicle to operate in a fuel economy mode based on a desired fuel economy preference. The fuel economy control logic is in electrical communication with a vehicle system controller and may be integrally formed as a sub-module within the vehicle system controller. A fuel economy control switch controlled by the fuel economy control logic toggles between an on and an off position to enable or disable a fuel economy mode. This related to a fuel economy control system and strategy for an alternative fuel vehicle such as an electric, a hybrid electric, or a fuel cell vehicle, by a switching functions depending upon a multitude of inputs on the vehicle operating conditions. However this system suffers from complexity, it comprises of an electric, a hybrid electric, or a fuel cell vehicle for its operation.

JP2005214086A discloses eco-friendly power drive device wherein communication interface is connected to the microcomputer equipped with the keyboard switch and the indicator. It controls the air fuel ratio using the fuel-injection-quantity-regulating-function in the engine control unit of the vehicle. Fuel-injection control is corrected by the travelling driving working state of vehicle. The microcomputer connected to the engine control unit of said vehicle through a communication interface has a vehicle-type discrimination function. It connects to the engine control unit of any vehicle through a communication interface, a fuel-injection-quantity correction can be appropriately selected and performed for that vehicle type.

This system disclosed in JP2005214086A suffers from drawbacks such as (i) need of an interfacing unit in between the Engine ECU and Input switch; (ii) Average capability of a vehicle specification at the time of factory shipments; (iii) Switch over from ECO to Normal to Power is dependent on Pedal position; (iv) Factory setting is sub optimal, More complex system, More reliability issues, Safety issues as switching is dependent upon Acceleration Pedal; (v) Use of complex algorisms adding to the failure modes, requires lot many inputs for effective functioning; (vi) Limited to gasoline vehicles, (vii) need of physical Linkages leading more number of parts and in turn reliability issues.

Japanese patent. JP2011196346A discloses a vehicle apparatus. It operates in a mode when the control apparatus is switched to the low-fuel-consumption mode. The information of the state of the vehicle is acquired by the vehicle status information acquisition means. The engine power of the said vehicle exists in a condition with required raising rapidly, the signal made to be switched from the said low-fuel-consumption mode to a said normal mode is output to the said control apparatus. The system disclosed suffers from the drawback that extensive vehicle data (gradient, engine speed, distance to previous vehicle, 1st relative velocity of the previous vehicle, highway main line, maps to limit vehicle rapidly raising phenomena to save the fuel consumption.

U.S. Pat. No. 8,224,560 disclose eco-drive Support Device and Method of notification to the driver to use eco drive based on the multiple inputs. However the system requires road information, requires continuous information from accepted on its position and many more inputs requires to notify the user.

U.S. Pat. No. 8,352,150 discloses engine control apparatus comprising driving-state detection (accelerator opening-degree change rate i.e. amount of actuation of acceleration pedal), storage means (for storing the mode maps), the engine control modes (3 modes—power mode, save mode and a normal mode). One of the engine control modes are selected on the basis of vehicle speed and a weighted average sums of parameters corresponding to plurality of events based on driving state detected. This system suffer from the drawback that it needs intricate algorithms involving multiple inputs from various sensors in the vehicle.

SUMMARY

The main object of the present invention is to provide power or economy mode selection and control system for an automotive vehicle.

Further object of the invention is to provide a system and method to enable selection of power mode operation for power conscious driving requirement or economy mode operation for fuel conscious driving option obviating the use of additional interface devices between engine and engine control unit.

Another object of the invention is to effectively utilize functionality of already existing sensors, actuators and controllers of the engine and vehicle system to enable a variant mode of engine vehicle to operate on economic or power mode for enhanced performance.

Another object of the invention is to provide a system to enable regulation of torque delivery profile for power as well as economic mode operation to achieve fuel saving.

Another object of the invention is to enable substantial fuel saving and enhanced performance with minimum additional components/devices and input information for economic and or power mode function of the vehicle.

Another object of the present invention is to provide a method of controlling engine output torque at various/multiple mode of operation depending upon user requirement by only switching operation.

Yet another object of the present invention is to provide a system with real time driving option to drive the vehicle in power or economy mode.

Another object of the invention is to obviate use of additional interface devices between engine and engine control unit along with multiple sensor information to enable power economic mode function.

Another object of the invention is to obviate intricate additional algorithms to achieve/activate the Power-Eco mode of operation.

Yet another object of the invention is to regulate/control air fuel ration as per the economic mode requirement.

Yet another object of the invention is to set the optimum or best performance from factory settings wherein fuel saving mode is aimed at.

Another object of the invention is to enable switching of the mode based on the driver input.

Yet another object of the invention is to obviate dependence of economic or power mode on acceleration pedal position.

Yet another object of the invention is to obviate additional linkage mechanisms relating to acceleration pedal.

Another object of the invention is to obviate inputs to the ECU in the form of acceleration pedal position to operate the vehicle in a particular mode. Further object of the invention is to provide flexibility to the driver to select mode of operation using the toggle switch that is independent of the acceleration pedal position.

Yet another object of the invention is to provide a single Electronic Control Unit for the operation of both the power and economic mode.

BRIEF DESCRIPTION OF THE FIGURES

The objectives and advantages of the present invention will become apparent from the following description of the preferred embodiments.

DETAILED DESCRIPTION

Figure 1:
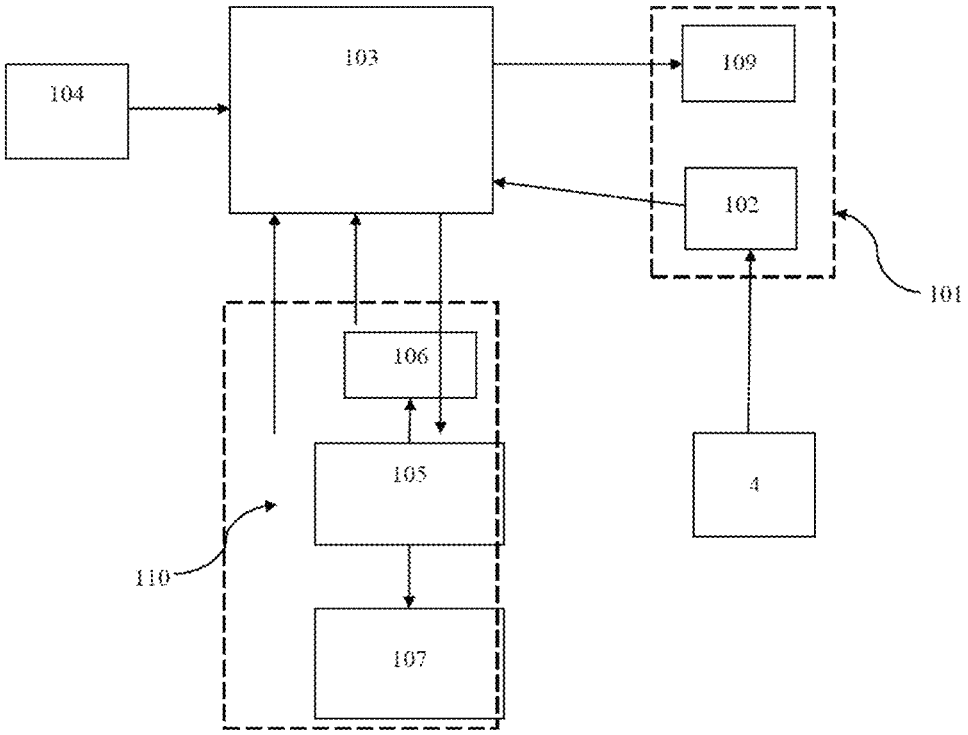
FIG. 1 is a configuration layout schematically showing the entire structure of a vehicle power train into which an ECU in accordance with a first embodiment of the present invention is incorporated.

FIG. 1 illustrates the configuration of the system to enable power and economy mode operations. It comprises of power train 110, electronic control unit 103, mode selection switch 102, accelerator pedal input 104, and mode indication lamp 109. The power train unit 110 comprises of engine 105, engine speed sensor 106 and transmission unit 107. The mode selection switch 102 and indication lamp 109 are adapted to be mounted on the vehicle dashboard instrument panel cluster 101. The said electronic control unit is operably configured with the engine speed sensor 106, engine 105, accelerator pedal mechanism 104 and mode selection switch 102. The driver of the vehicle selects the desired mode (power or economy) by operating the said selection switch 102. The input from the said switch is fed to the said electronic control unit 103 to process it wherein the said unit operates to send a signal to the engine to switch over the mode. The active mode of operation (power/economy) is indicated by the system by enabling visual indication with the aid of indication lamp 109 mounted on the dashboard of the vehicle.

The ECU (103) comprises an analog signal conditioner, digital signal conditioner, CPU, program memories namely EPROM and E2PROM, power stage controller, CAN, and diagnostics and alarms. The inputs to the ECU typically include engine speed, CAM PHASE, coolant temperature, accelerator pedal position, air mass flow, air temperature, boost pressure, brake switch, clutch switch, air conditioning, battery, etc. The output from the ECU includes actuation of injector, metering unit, EGR, boost pressure, radiator fan, glow plug, etc. The diagnostic functions include high coolant temperature warning, low battery voltage warning etc.

Power mode (PWR) and Economy mode (ECO) are the two indications corresponding to the two modes of driving. Power mode operation refers to the vehicle operation with power conscious driving requirement while economy mode operation gives one more option of fuel conscious driving requirement. The shifting between the two different modes is facilitated with a help of a switch depending on driving conditions.

A 2D Power Mode Map of the engine is generated and stored in the EPROM. Further a 2D Economic Mode Map is generated and stored in the EPROM.

The 2D Power map is a relationship of engine speed and maximum fueling in power mode for 100% accelerator pedal position.

The 2D Economy Map is a relationship of engine speed and maximum fueling/torque in economic mode for 100% accelerator pedal position.

The power economy modes of operation are selected based on driving requirements in the form of driver's input through Power Economy Switch 102. According to the input, respective indication appears i.e. PWR/ECO in the form visible display 109 on the vehicle dash board/Instrument Panel Cluster 101.

On input from the driver and the feedback from engine speed sensor 106, ECU refers to the 2D Power Map and selects the predefined fueling for a particular engine speed at 100% accelerator pedal, actuates the injector to supply the selected quantity of fuel to the engine to run in the power mode.

On input from the driver and the feedback from engine speed sensor 106, ECU refers to the 2D Economic Map and selects the predefined fueling/torque for a particular engine speed at 100% accelerator pedal, actuates the injector to supply the selected quantity of fuel to the engine to run in the economy mode.

Figure 5:
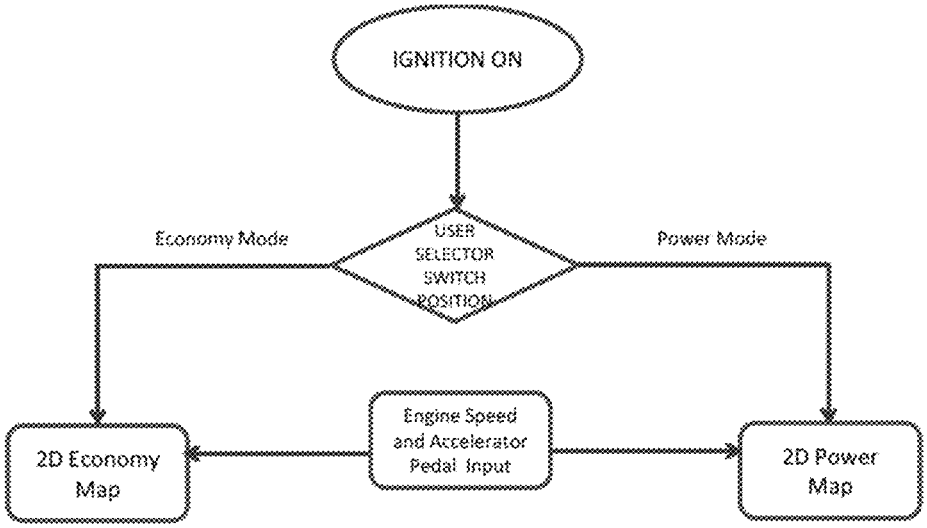
FIG. 5 shows the working flow chart of the system in accordance with the present invention.

FIG. 5 illustrates the process steps comprising activation of ignition;

allowing user selector switch operation activating desired mode receiving signal relating to the selection of power economy modes of operation based on driving requirements in the form of driver's input through power economy switch 102;

display of the indication in the form visible display (109) on the vehicle dash board (101) according to the said input;

acquiring feedback from engine speed sensor (106) and feeding it to the said ECU;

processing the 2D Power Map (or Economy Map as per the mode selection) in the ECU to select the predefined fueling for a particular engine speed at 100% accelerator pedal;

sending the signal to actuate engine injector to supply the selected quantity of fuel to the engine to run in the power mode.

Figure 2:
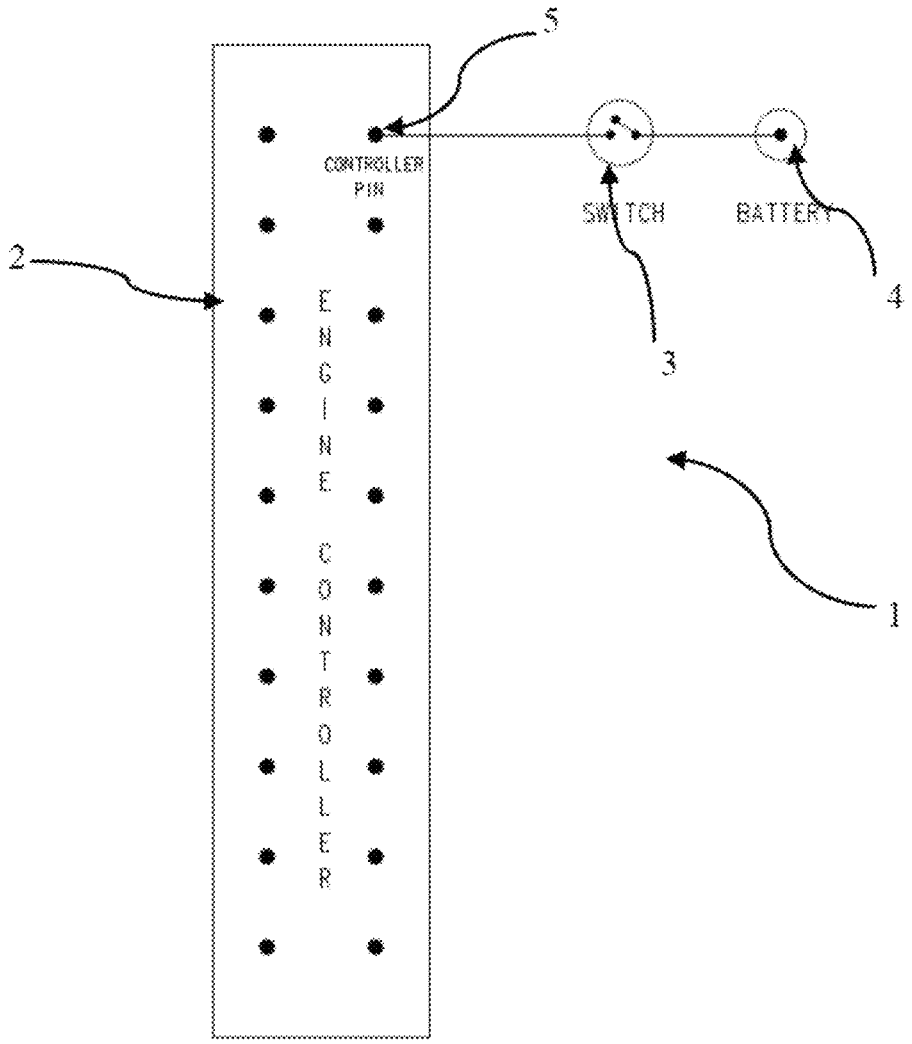
FIG. 2 shows the block diagram of the operation mode control system of the present invention.

As indicated in FIG. 2, electronic control unit 2 is configured with selector switch 3 and the main battery 4 of the vehicle. A selection switch 3 is introduced in between the controller Pin 5. The said pin 5 is adapted based on the actuation of the economy mode. The ECU (2) is connected to the various sensors and actuators on the engine and vehicle by a series of electrical wires (collectively called as wiring harness). The said switch 3 is mounted on the vehicle dashboard and is introduced in series with the battery and ECU.

Figure 3:
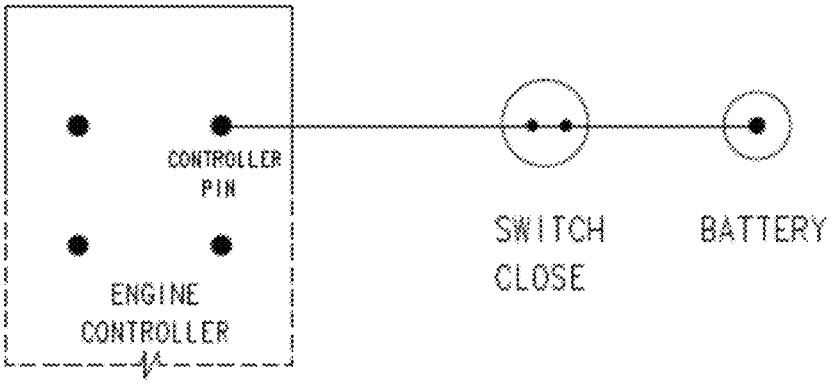
FIG. 3 shows the CLOSE position of the selector switch in the operation mode control system of the present invention.
Figure 6:
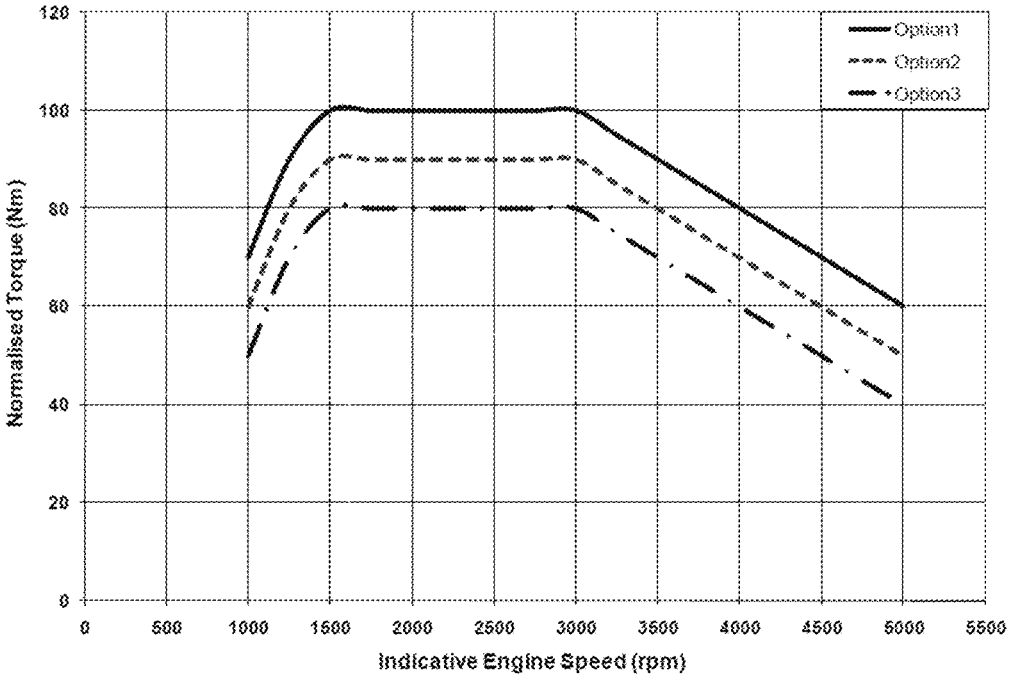
FIG. 6 shows the engine output curves (RPM vs Torque) in economy mode in accordance with the present invention.
Figure 7:
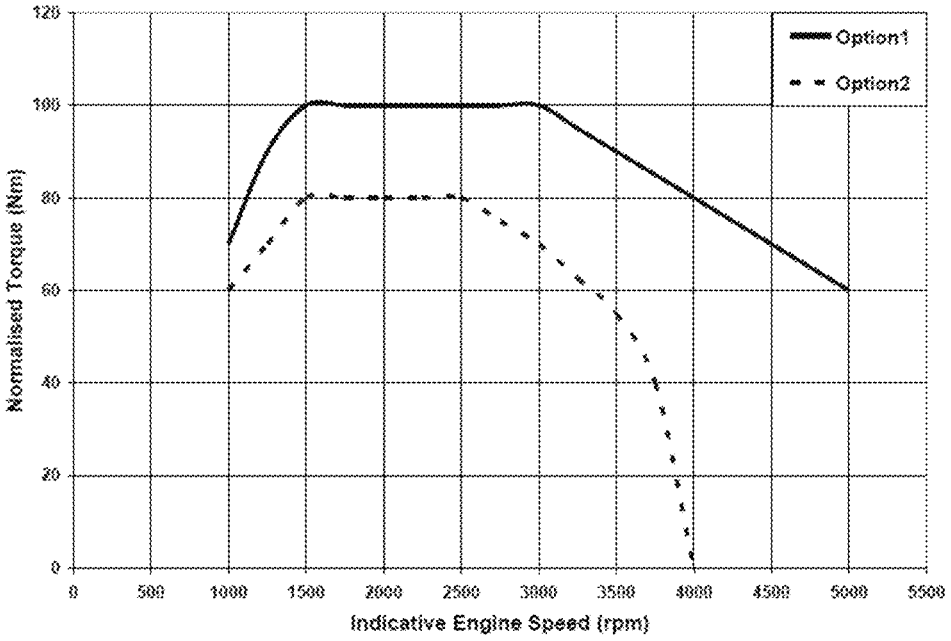
FIG. 7 shows the engine output curves (RPM vrs Torque)—Type 2 in accordance with the present invention.
Figure 8:
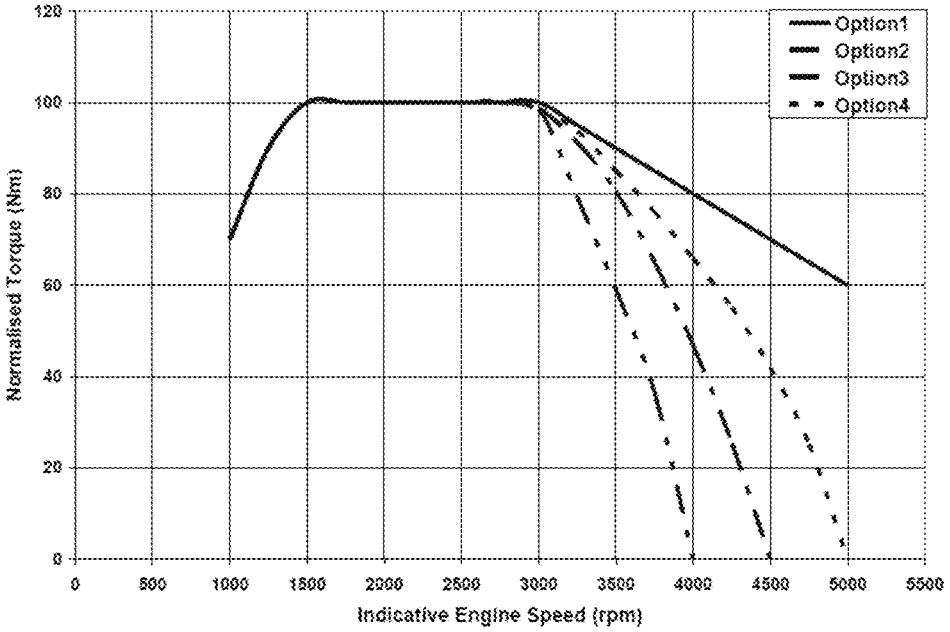
FIG. 8 shows the engine output curves (RPM vrs Torque)—Type 3 in accordance with the present invention.
Figure 9:
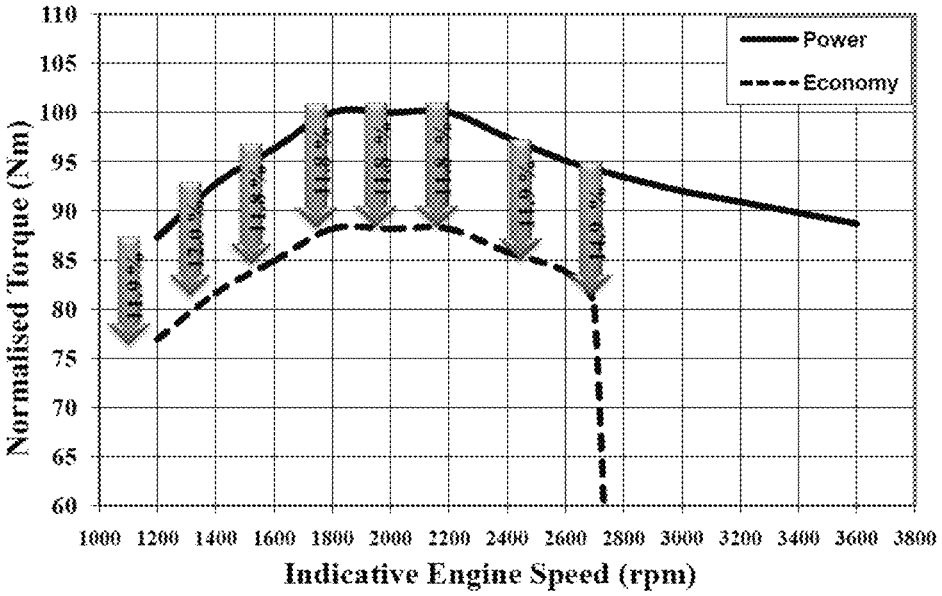
FIG. 9 is a plot showing the difference in the performance between the two modes of operation of the present invention i.e. Power and Economy underlining the energy saving feature in accordance with the first embodiment.

As depicted in FIG. 3, the selector switch 3 is in CLOSED position. The electronic control unit 2 is activated to sense that all functions are closed and allows engine/vehicle to operate under power mode characterized by Option 1 as represented in FIGS. 6, 7 and 8. It is to be noted that the representations in FIGS. 6, 7 and 8 are provided for comprehending the nature of the engine torque curve and is not indicative and limited to the actual values of the torque and rpm of particular engine.

The Option 1 is characterized by the maximum possible torque (Normalized to 100) that can be produced of an engine. In the power mode, the system retains the existing engine torque thereby retaining the best performance.

Figure 4:
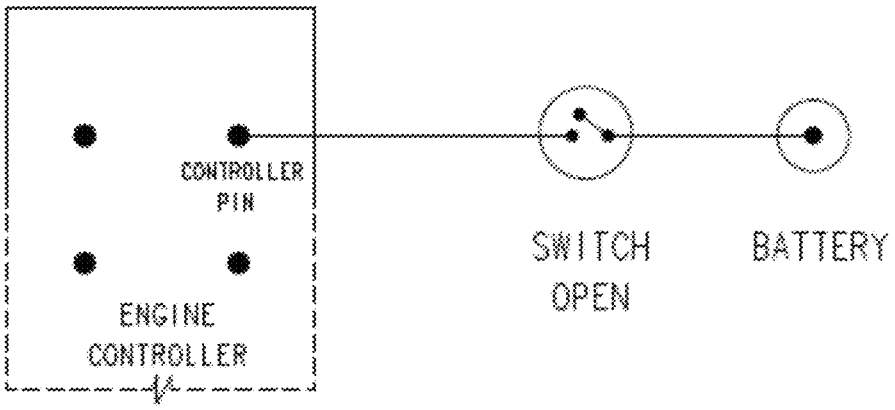
FIG. 4 shows the OPEN position of the selector switch in the operation mode control system of the present invention.

FIG. 4 depicts the OPEN position of the selector switch 3. When the selector switch (3) is in the OPEN condition, the ECU (2) activates the 2D Economy Map, selects the predefined fueling/torque as set in the Map thereby enabling the engine output in accordance with engine torque options 2, 3, and 4 as illustrated in FIGS. 6, 7 and 8:

The options for economy mode are including but not limited to degrading (reduction of torque), derating (reduction of engine rated speed).

In Option 2 and 3 as illustrated in FIG. 6, the torque of the engine is proposed to be reduced at the entire speed range of the engine.

In option 2 as depicted FIG. 7, torque as well as the speed of the engine is reduced.

In option 2, 3, 4 shown in FIG. 8, the peak torque is same as that of the normal mode, but engine speed is reduced.

The reduction can take place in three different characterizations as shown in FIGS. 6, 7, and 8, in terms of peak torque and rated speed, thus gaining on fuel consumption.

Fuel economy gains of 10-15% in the economy mode of operation as validated in on-road vehicle testing.

The engine controller 2 is enabled in the power mode if the selector switch 3 is in close position. Similarly, the engine controller is enabled in the economy mode if the selector switch 3 is in the open position.

It is evident that the present invention as compared to the prior art, does not need any additional interface devices between engine and engine control unit and multiple sensor information to achieve the power/economy mode operations. Further it does not require complex algorithms to be built into the system to achieve/activate the Power/Economy mode of operation.

It is to be appreciated that the present invention achieves fuel efficiency enhancement of 10-15% as validated in on-road conditions.

It should be understood that the present invention is not to be limited by the exact details of the illustrated embodiment. However, it is to be taken as the preferred example of the invention and that various changes may be resorted to by a person skilled in the art without departing from the spirit of the invention. Also, the terminologies used herein are for the purpose of description and should not be regarded as limiting.

What is claimed is:

1. A power-economy mode control system for a vehicle, comprising:

a power train (110), an electronic control unit (103), a mode selection switch (102), an accelerator pedal input (104), and a mode indication lamp (109), wherein said power train (110) having an engine (105), an engine speed sensor (106), and a transmission unit (107); wherein said electronic control unit is operationally configured with said engine speed sensor, said engine, said accelerator pedal input and said mode selection switch;

said electronic control unit configured to:

receive a signal from said mode selection switch and inputs including an engine speed, a coolant temperature, an accelerator pedal position, an air mass flow, an air temperature, air conditioning, and a battery of said vehicle, wherein said received signal is regarding selection of at least one of a power mode (PWR) and an economy mode (ECO) based on at least one input from a user, wherein said power mode is a vehicle operation based on a 2D power map and said economy mode is said vehicle operation based on a 2D economy map; and provide diagnostic functions that includes at least one of a high coolant temperature warning and a low battery voltage warning;

said mode indication lamp configured to provide visual indication of selected said at least one of said power mode and said economy mode, wherein said mode indication lamp is mounted on a dashboard of said vehicle; and wherein said electronic control unit configured to provide an output signal to an actuate engine injector to supply selected quantity of fuel to said engine to operate in said at least one of said power mode and said economy mode.

2. The power-economy mode control system for a vehicle as claimed in claim 1, wherein said 2D Power map is a relationship of said engine speed and maximum fueling in said power mode for 100% said accelerator pedal position.

3. The power-economy mode control system for a vehicle as claimed in claim 1, wherein said power mode is selected when said mode selection switch is in CLOSED position, wherein said CLOSED position said electronic control unit is activates said 2D power map to sense that all functions are closed and allows said engine of said vehicle to operate in said power mode characterized by maximum possible torque that is normalized is produced by said engine.

4. The power-economy mode control system for a vehicle as claimed in claim 2, wherein said economy mode is selected when said mode selection switch is in OPEN position, wherein said OPEN position said electronic control unit activates said 2D Economy Map, and selects at least one of a predefined fueling and a torque as set in said 2D Economy Map thereby enabling said engine output in accordance with engine torque option.

5. The power-economy mode control system for a vehicle as claimed in claim 1, wherein said vehicle operates in said power mode to reduce said engine torque at an entire speed range of said engine.

6. The power-economy mode control system for a vehicle as claimed in claim 1, wherein said vehicle operates in said economy mode to reduce said engine torque and reduce an engine rated speed.

7. The power-economy mode control system for a vehicle as claimed in claim 1, wherein said 2D Economy Map is a relationship of said engine speed and at least one of said maximum fueling and said torque in said economic mode for 100% said accelerator pedal position.

* * * * *